US007380426B2

(12) United States Patent
Dalton, Jr. et al.

(10) Patent No.: US 7,380,426 B2
(45) Date of Patent: Jun. 3, 2008

(54) PANEL LOCK FOR ELECTRONIC, ELECTRICAL OR CONTROL CABINETS

(75) Inventors: Robert E. Dalton, Jr., Mauldin, SC (US); Donald N. Hesprich, Salisbury, NC (US)

(73) Assignee: CompX International Inc., Greenville, SC (US)

( * ) Notice: Subject to any disclaimer, the term of this patent is extended or adjusted under 35 U.S.C. 154(b) by 0 days.

(21) Appl. No.: 11/524,045

(22) Filed: Sep. 20, 2006

(65) Prior Publication Data

US 2007/0068206 A1 Mar. 29, 2007

Related U.S. Application Data

(60) Provisional application No. 60/721,761, filed on Sep. 29, 2005.

(51) Int. Cl.
*E05B 13/00* (2006.01)

(52) U.S. Cl. ..... 70/100; 70/129; 70/208; 70/210; 292/153; 292/170; 292/DIG. 31

(58) Field of Classification Search ..... 70/129, 70/89, 90, 100, 150, 467, 208, 210, 488; 292/153, 154, 170, 175, DIG. 31, DIG. 38; 49/180, 449

See application file for complete search history.

(56) References Cited

U.S. PATENT DOCUMENTS 583,549 A * 6/1897 Richardson ..... 70/355
2,103,989 A * 12/1937 Machinist ..... 70/131
2,468,406 A * 4/1949 Mora ..... 70/129
3,095,225 A * 6/1963 Domsic et al. ..... 292/169.15
3,668,906 A * 6/1972 Josephart ..... 70/90
4,545,225 A * 10/1985 Mihojevich ..... 70/71
4,641,506 A * 2/1987 Boucher ..... 70/129
4,669,765 A * 6/1987 Ullman ..... 292/153
4,673,202 A * 6/1987 Willis ..... 292/162
4,676,081 A 6/1987 Craig
4,683,736 A * 8/1987 Weinerman et al. ..... 70/208
4,837,975 A * 6/1989 Simpson ..... 49/175
4,882,919 A 11/1989 Craig
5,096,240 A * 3/1992 Schultz ..... 292/153
5,121,951 A * 6/1992 Harbom et al. ..... 292/175
5,145,221 A * 9/1992 Pennebaker et al. ..... 292/175
5,315,850 A * 5/1994 Edeus et al. ..... 70/129
5,897,147 A * 4/1999 Alyanakian et al. ..... 292/175
5,931,032 A * 8/1999 Gregory ..... 70/129
5,934,115 A * 8/1999 Bernier et al. ..... 70/208
5,974,842 A * 11/1999 Schlack et al. ..... 70/208
6,311,439 B1 * 11/2001 Arcati et al. ..... 52/204.51
6,474,118 B2 11/2002 Martinez
6,477,872 B1 * 11/2002 Denton, Jr. ..... 70/129
6,513,357 B2 2/2003 McCurry
6,553,796 B2 4/2003 Finch

* cited by examiner

*Primary Examiner*—Lloyd A Gall
(74) *Attorney, Agent, or Firm*—Dority & Manning, P.A.

(57) ABSTRACT

Disclosed is a lock assembly such as for use with enclosures and access panels. The lock assembly includes a keyhole shaped aperture in a slide portion of the locking assembly that cooperates with double-D shaped protrusions associated with a locking plug. In a locked position, the double-D shaped protrusions inhibit movement of the slide portion. In an unlocked position, the double-D shaped elements may enter a more narrow portion of the keyhole shaped aperture and permit movement of the slide. The slide is associated with additional features so that movement of the slide selectively inhibits or provides consequential movement of other elements that in turn respectively deny or create access to an enclosure.

12 Claims, 2 Drawing Sheets

PANEL LOCK FOR ELECTRONIC, ELECTRICAL OR CONTROL CABINETS

PRIORITY CLAIM

This application claims the benefit of previously filed U.S. Provisional Patent Application entitled "PANEL LOCK FOR ELECTRONIC, ELECTRICAL OR CONTROL CABINETS," assigned U.S. Ser. No. 60/721,761, filed Sep. 29, 2005, and which is incorporated herein by reference for all purposes.

FIELD OF THE INVENTION

The present subject matter relates to locks. More particularly, the present subject matter relates to a panel lock for use with a locking bar system, and to selectively closable enclosures incorporating such present panel lock subject matter.

BACKGROUND OF THE INVENTION

The incorporation of locking devices into access openings for enclosures of all types yields many practical advantages. In the case of electrical enclosures such as control cabinets or other enclosures housing electrical or electronic devices, restricted access may be essential for safety reasons as well as to respond to certain legal requirements placed by certain governmental entities.

One example of a known device relating to an electrical panel lock is shown by U.S. Pat. No. 6,553,796 to Finch, entitled "Electrical panel lock with locking plug head." In such patent, a panel lock includes a housing with a pivotal face plate arranged to engage a bolt upon pivotal movement of the face plate. A rotatable plug assembly may be rotated between a locking and unlocking position to restrain or release the push plate.

The desire for the incorporation of locking devices into access openings for enclosures can arise in other, non-electrical environments. For example, McCurry, U.S. Pat. No. 6,513,357 is entitled "Key retention mechanism for mail lock box" and shows a customer key actuated lock. Such disclosed lock includes a retention mechanism that prevents counterrotation of the customer key plug to rotation from the locked position toward the unlocked position and further includes a release mechanism to disengage the retention mechanism.

Yet another circumstance that could involve incorporation of a locking device into an otherwise removable or openable element may relate to a lock for attaching a cover to a platform. Such a circumstance is disclosed in Martinez, U.S. Pat. No. 6,474,118, entitled "Scissors latch lock." In such arrangement, a lock for attaching a cover to a platform includes first and second pivotally mounted latch bars which spread to engage side walls of a strike opening in response to actuation of a key actuated rotatable plug mounted in the housing of the lock. The latch bars are mechanically spread to engage the strike in a positive manner and do not rely upon biasing means to maintain the lock in the locked position.

Additional arrangements relating to panel lock constructions include as disclosed in Craig, U.S. Pat. No. 4,882,919, entitled "Flush mounted panel lock construction" and also by Craig, U.S. Pat. No. 4,676,081, entitled "Snap-in semi-flush mounted panel lock."

All of the foregoing United States Patents involve commonly owned interests with that of the present subject matter, and the disclosures of all such patents are fully incorporated herein for all purposes.

While various implementations of panel locks have been developed, no design has emerged that generally encompasses all of the desired characteristics as hereafter presented in accordance with the subject technology.

SUMMARY OF THE INVENTION

In view of the recognized features encountered in the prior art and addressed by the present subject matter, improved apparatus and methodology for providing a panel lock assembly for use with a locking bar have been developed. More specifically, improved apparatus and methodology for providing a linearly displaceable panel lock assembly have been developed.

Still another present more general object is to provide a simplified device used to actuate and secure a locking bar in a cabinet. Another positive aspect of a present device is that linear slide motion is permitted without requiring hook cams, complicated slide mechanisms, spring loaded components, or other complex structures.

Yet another aspect of certain embodiments of the present subject matter is that the housing includes no metallic parts exposed to the back, thereby reducing the risk of accidentally energizing the lock plug or key. At the same time, it is a present object to facilitate providing a device that may be practiced with essentially any application in which a cabinet needs to be secured (e.g., any lab, electrical, electronic, or control cabinet).

In the foregoing context, it is a further present object to provide a panel lock for electronic, electrical, or control cabinets or the like, which is relatively more simple to build and use. In such context, it is a further present object to provide such an improved panel lock that facilitates lifting of the locking bar of a cabinet.

In a present exemplary configuration, a snap in housing supports a linearly movable slide and a lock assembly such that the slide is inhibited from moving while the lock is engaged and allowed to move while the lock is disengaged.

In one of its simpler forms, an exemplary panel lock in accordance with the present technology comprises a keyhole shaped aperture formed in a portion of such movable slide and cooperating with a "double-D" shaped engagement mechanism.

In yet another present exemplary embodiment, present subject matter may for example relate to a panel lock assembly for use with a locking bar of an associated selectively closable enclosure of the type including a cavity, such enclosure having opposite sides and a front face opening for accessing such enclosure. In such an exemplary embodiment, such exemplary panel lock assembly may preferably comprise an elongated housing portion, received in the enclosure front face opening; a slide element, and a rotatable plug assembly.

In the foregoing exemplary embodiment, such slide element may be preferably supported by the elongated housing portion, for user-actuated linear movement relative to such elongated housing portion, with such slide element including at least one engagement tip for selectively engaging a locking bar of an associated enclosure, and with such slide element also defining an engageable opening therethrough.

Still further in such exemplary embodiment, the rotatable plug assembly may be mounted in the elongated housing portion, and including a key slot for receipt of a key to actuate rotation of such rotatable plug assembly. Furthermore, such rotatable plug assembly may include at least one protrusion extending therefrom and into the slide element engageable opening, with such at least one protrusion rotating in response to rotation of the rotatable plug assembly between a locking position and an unlocking position thereof. With such a present exemplary arrangement, advantageously the at least one protrusion engages the slide element engageable opening to prevent linear movement of the slide element whenever the rotatable plug assembly is in the locking position thereof, and to permit linear movement thereof whenever the rotatable plug assembly is in the unlocking position thereof, whereby a simplified panel lock assembly is provided to selectively actuate and secure a locking bar of an associated selectively closable enclosure.

Various additional present aspects may be optionally or alternatively practiced to create still further present exemplary panel lock assemblies. For example, the elongated housing portion may be configured to include a pair of frictionally engaging retaining elements on one end thereof, a window opening through the elongated housing portion for user-actuation of slide element, and a surrounding lip portion arranged with the remainder of the elongated housing portion so as to facilitate "snap-in" mounting of the panel lock assembly into the front face opening of an associated enclosure.

Still further, alternatively the slide element may include a recessed portion thereof which may be accessed via the window opening of the elongated housing portion to effect linear movement of the slide element. As for still further possibilities, the panel lock assembly may further include a bottom housing portion beneath the elongated housing portion and cooperating therewith for retaining the slide element in linear movement relationship relative to the elongated housing portion. When so configured, advantageously, the slide element may optionally further include a pair of safety side wing elements for shielding such as a user's finger received in such recessed portion thereof from projecting into the interior of an associated enclosure.

In still additional optional present arrangements, the slide element engageable opening may be generally keyhole-shaped, while correspondingly the at least one protrusion of the rotatable plug assembly may include a pair of D-shaped protrusions, engageable in one orientation with the slide element engageable opening so as to prevent linear movement of the slide element which consequently prevents engagement of the slide element at least one engagement tip engaging a locking bar of an associated enclosure, and engageable in another orientation with the slide element engageable opening so as to permit linear movement of such slide element which consequently permits engagement of such slide element at least one engagement tip engaging a locking bar of an associated enclosure.

Still further per present alternative subject matter, an associated enclosure may be comprised of one of an electrical and non-electrically associated enclosures, and the elongated housing portion and the slide element may be comprised of non-conductive materials to reduce shock exposure from any energized electrical components otherwise residing with an associated enclosure.

Yet an additional present exemplary embodiment of the present subject matter may relate to a snap-in panel lock assembly for receipt into a front face opening of an associated selectively closable enclosure, for inhibiting access to such closeable enclosure whenever a lock of such lock assembly is engaged, and for allowing access to such closeable enclosure whenever a lock of such lock assembly is disengaged. Preferably, per such exemplary embodiment, such a present panel lock assembly comprises an elongated housing portion, a rotatable plug assembly, a slide element, a bottom housing portion, and at least one asymmetrically shaped protrusion.

In the foregoing exemplary embodiment, such elongated housing portion preferably defines a snap-in upper lip portion for receipt of such elongated housing portion in the enclosure front face opening, and defines a window opening therethrough.

Still further, the foregoing rotatable plug assembly is preferably mounted in the elongated housing portion, while the rotatable plug assembly preferably includes a key slot for receipt of a key to actuate rotation of the rotatable plug assembly.

The foregoing exemplary slide element is preferably supported by the elongated housing portion, for linear movement thereof relative to the elongated housing portion per user actuation of the slide element through the window opening, with such slide element defining at least one engagement projection extending therefrom, and defining an engageable opening therethrough, with such engageable opening being asymmetrical along an axis perpendicular to the linear movement direction of the slide element.

The foregoing bottom housing portion is preferably beneath the elongated housing portion and cooperating therewith for retaining the slide element in linear movement relationship relative to such elongated housing portion. The above-mentioned at least one asymmetrically shaped protrusion is preferably extending beneath the rotatable plug assembly for rotation therewith, and extending into the slide element engageable opening. Accordingly, such at least one protrusion preferably is rotating in response to rotation of the rotatable plug assembly between a locking position and an unlocking position thereof, wherein such at least one protrusion engages the slide element engageable opening to prevent linear movement of such slide element whenever the rotatable plug assembly is in the locking position thereof, and to permit linear movement thereof whenever such rotatable plug assembly is in the unlocking position thereof, so that the at least one engagement projection of the slide element interacts with the closeable enclosure so as to inhibit access to the interior of the enclosure whenever the lock is engaged and so as to permit access to the interior of the enclosure whenever the lock is disengaged.

Various additional present aspects may be further optionally or alternatively practiced to create still further present exemplary panel lock assemblies. For example, in the foregoing exemplary panel lock assembly, the elongated housing portion may be configured to include a pair of frictionally engaging retaining elements on one end thereof. At the same time, or further alternatively, the slide element may include a recessed portion thereof which may be accessed via the window opening of the elongated housing portion to effect linear movement of the slide element. Such slide element may further include a pair of safety side wing elements for shielding such as a user's finger received in the recessed portion thereof from projecting into the interior of an associated enclosure.

Still further, the foregoing exemplary slide element engageable opening is preferably a generally keyhole-shaped, and the at least one protrusion of the rotatable plug assembly includes a pair of D-shaped protrusions, engageable in one orientation with said such slide element engageable opening so as to prevent linear movement of the slide element which consequently prevents engagement of such slide element at least one engagement tip engaging a locking bar of an associated enclosure, and engageable in another orientation with such slide element engageable opening so as to permit linear movement of such slide element which consequently permits engagement of the slide element at least one engagement tip engaging a locking bar of an associated enclosure.

Still further, an associated enclosure may be comprised of one of an electrical and non-electrically associated enclosures, and the elongated housing portion, the bottom housing portion, and the slide element may preferably all be comprised of non-conductive materials to reduce shock exposure from any energized electrical components otherwise residing with an associated enclosure.

Additional objects and advantages of the present subject matter are set forth in, or will be apparent to, those of ordinary skill in the art from the detailed description herein. Also, it should be further appreciated that modifications and variations to the specifically illustrated, referred and discussed features and elements hereof may be practiced in various embodiments and uses of the present subject matter without departing from the spirit and scope of the subject matter. Variations may include, but are not limited to, substitution of equivalent means, features, or steps for those illustrated, referenced, or discussed, and the functional, operational, or positional reversal of various parts, features, steps, or the like.

Still further, it is to be understood that different embodiments, as well as different presently preferred embodiments, of the present subject matter may include various combinations or configurations of presently disclosed features, steps, or elements, or their equivalents (including combinations of features, parts, or steps or configurations thereof not expressly shown in the figures or stated in the detailed description of such figures). Additional embodiments of the present subject matter, not necessarily expressed in the summarized section, may include and incorporate various combinations of aspects of features, components, or steps referenced in the summarized objects above, and/or other features, components, or steps as otherwise discussed in this application. Those of ordinary skill in the art will better appreciate the features and aspects of such embodiments, and others, upon review of the remainder of the specification.

BRIEF DESCRIPTION OF THE DRAWINGS

A full and enabling disclosure of the present subject matter, including the best mode thereof, directed to one of ordinary skill in the art, is set forth in the specification, which makes reference to the appended figures, in which.

Figure 1:
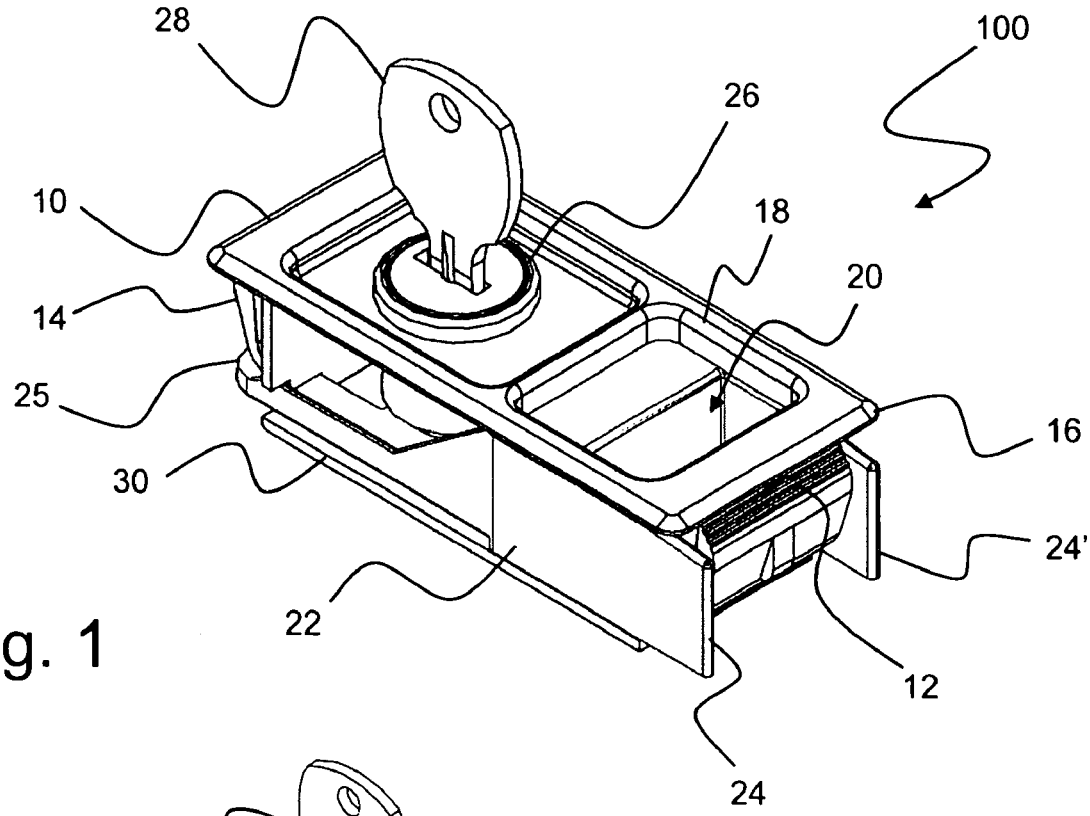
FIG. 1 is an assembly view of an exemplary lock assembly in accordance with the present technology.

Repeat use of reference characters throughout the present specification and appended drawings is intended to represent same or analogous features, elements, or steps of the present subject matter.

DETAILED DESCRIPTION OF THE PREFERRED EMBODIMENTS

As discussed in the Summary of the Invention section, the present subject matter is particularly concerned with panel locks for use with a locking bar system but also encompasses closable enclosures that incorporate such panel locks.

Selected combinations of aspects of the disclosed technology correspond to a plurality of different embodiments of the present subject matter. It should be noted that each of the exemplary embodiments presented and discussed herein should not insinuate limitations of the present subject matter. Features or steps illustrated or described as part of one embodiment may be used in combination with aspects of another embodiment to yield yet further embodiments. Additionally, certain features may be interchanged with similar devices or features not expressly mentioned which perform the same or similar functions.

Reference will now be made in detail to presently preferred embodiments of the subject panel lock assembly. Referring now to the drawings, FIG. 1 illustrates an assembled view of an exemplary lock assembly generally 100 in accordance with the present technology. As illustrated, elongated housing 10 thereof is configured to include frictionally engaging (i.e. interference elements) retaining elements 12, 14 on either end of such housing. Housing 10 is further configured with a surrounding lip portion 16 arranged with the remainder of the housing so as to facilitate a "snap-in" mounting of the exemplary lock assembly into a suitably formed hole in, for example, an access opening for an electrical component enclosure (not otherwise presently shown—see above-referenced patents, the disclosures of which are incorporated herein by reference).

It should be appreciated that the specific example given herein of use of a lock assembly in accordance with the present technology in association with an electrical component enclosure is representative only, and that such lock assembly may be used in conjunction with many different types of enclosures and access panels including both electrical and non-electrically associated enclosures, as further generally referenced above.

With further reference to FIG. 1, it will be seen that housing 10 may contain a window opening 18 through which a recessed portion 20 of exemplary slide element 22 may be accessed to effect linear movement of such slide 22 by, for example, a user inserting a finger tip through window opening 18 and engaging recessed portion 20. So long as locking plug 26 is in a defined unlocked position as made possible by operation of removable key 28, upward pressure applied to recessed portion 20 of slide 22 will permit movement of slide 22 and accompanying movement of representative safety wings 24, 24'. As will be understood by those of ordinary skill in the art, such safety wings 24, 24' prevent an operator's finger (or any tool used) from undesirably slipping through the side of the opening 20. Such movement of slide 22 also causes accompanying movement on the other end of slide 22 of tips 25, 25' thereof, which in turn would cause movement of locking bars (not shown) of an associated enclosure or the like, as will be understood by those or ordinary skill in the art.

Representative housing portion generally 30 completes the exemplary embodiment of the present lock assembly generally 100, and functions to retain slide 22 in position within housing portion 10. Housing portions 10 and 30 and slide element 22 may as desired be constructed of non-conductive materials in order to lessen the possibility of the locking plug 26 and key 28 accidentally being energized by contact with any enclosed electrical elements. In an exemplary embodiment, housing 10 and slide 22 may be constructed from a glass reinforced polymer while the lock plug assembly may be made from a suitable metal including, but not limited to brass, stainless steel, and zinc. Alternatively, depending on particular installations and implementations of the present subject matter, some or all of the housing and slide portions may be constructed of various metallic components, for added strength.

Figure 2:
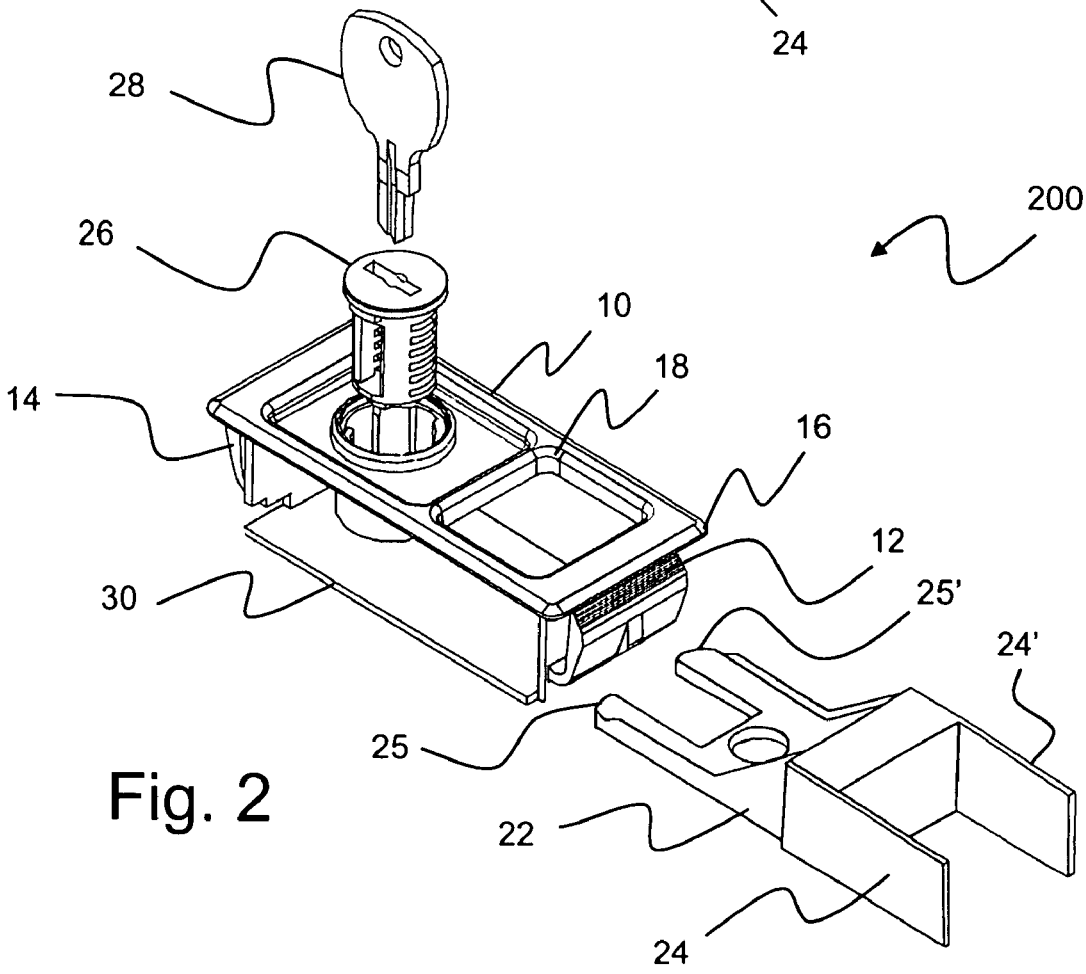
FIG. 2 is an exploded view, in perspective, of the exemplary lock assembly illustrated in FIG. 1.

With reference now to FIG. 2, there is illustrated exploded view, in perspective, of an exemplary panel lock generally 200 in accordance with the present technology. In the present instance, each of the numbered portions illustrated in FIG. 2 correspond identically to the equivalently numbered elements of FIG. 1, wherefore one of ordinary skill in the art will fully understand the illustrated features of present FIG. 2 on the basis of the additional information available in conjunction with the herewith description of present FIG. 1. In such present illustration of FIG. 2, key 28 is also withdrawn from locking plug 26 as part of the "exploded" nature of the view, while slide 22 is entirely withdrawn from the housing comprised of present housing portions 10 and 30.

Figure 3:
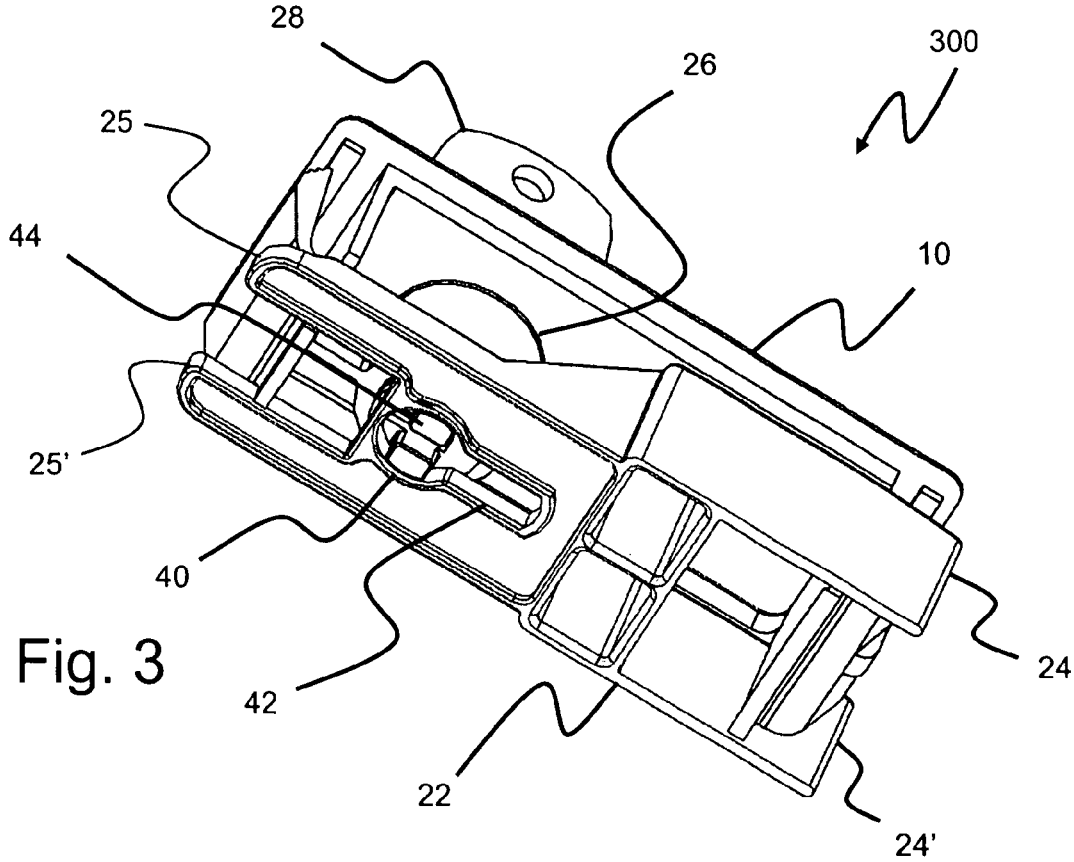
FIG. 3 is an isometric bottom view of the presently illustrated exemplary lock assembly (assembled) in a locked position thereof.

With reference to FIG. 3, there is illustrated a generally bottom, isometric view of the lock assembly (generally 300) in accordance with the present subject matter but with the bottom portion 30 of the housing previously illustrated in FIGS. 1 and 2 removed so that the operation of the exemplary lock mechanism may be more clearly seen. Visible in such FIG. 3 illustration, as will be understood by those of ordinary skill in the art, is a keyhole shaped opening in the lower portion of slide 22. Such keyhole shaped opening includes a generally rounded portion 40 thereof and an elongated opening portion 42 thereof.

As is illustrated in FIG. 3, the exemplary lock assembly generally 300 is shown in a defined locked position thereof, wherein double-D shaped protrusions generally 44 from locking plug 26 are rotated so as to inhibit movement of slide 22. Such inhibition of slide 22 likewise inhibits consequent movement of tips 25, 25', which in turn prevents movement of the associated locking bars (not shown).

Figure 4:
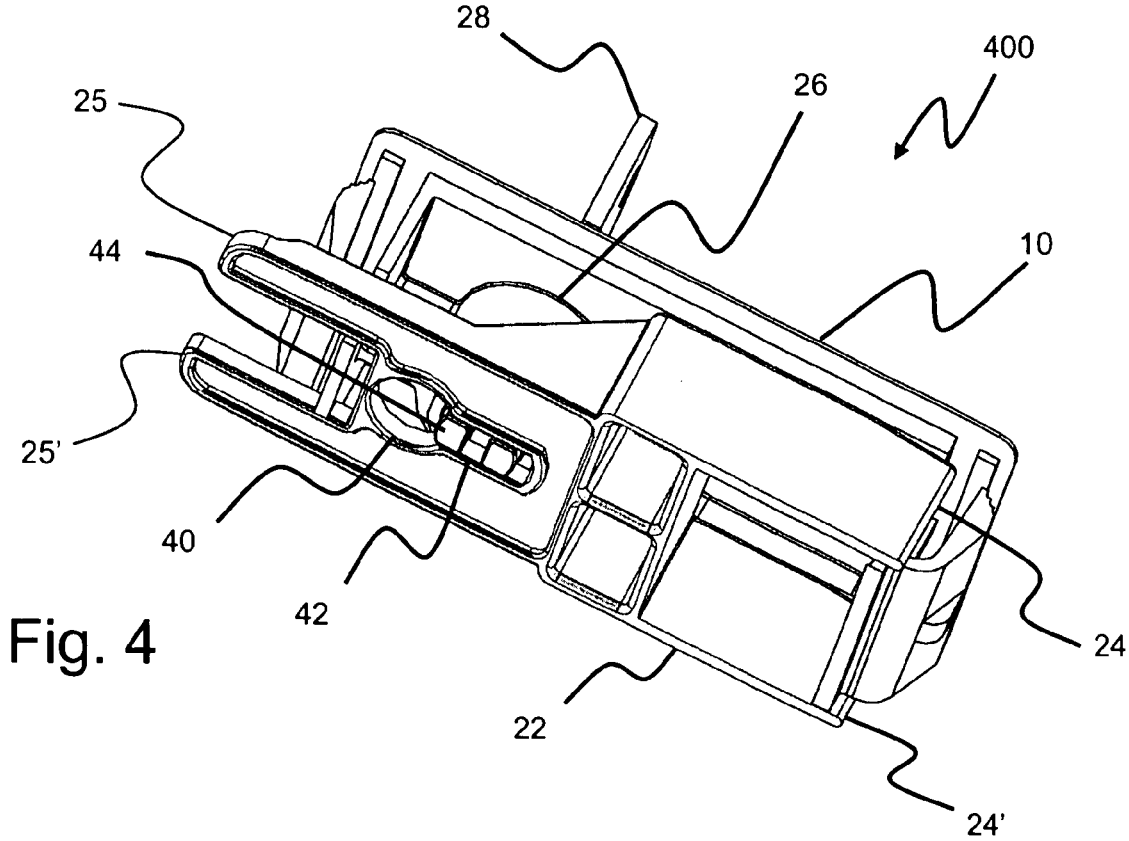
FIG. 4 is an isometric bottom view of such presently illustrated lock assembly (assembled) in an unlocked position thereof.

With reference to FIG. 4, the exemplary lock assembly generally 400 of the present subject matter is illustrated in a defined unlocked position thereof. As may be seen in such FIG. 4, the key 28 has been rotated (such as 90°) from the position of such key 28 as otherwise illustrated in FIG. 3, so as to unlock the panel lock. Rotation of key 28 and consequent rotation of the cylinder of lock plug 26 allows the double-D shaped protrusions 44 of lock plug 26 to also be rotated. Such action allows such double-D shaped protrusions 44 so oriented (as in FIG. 4) as to fit within (and along) the extended portion 42 of the keyhole shaped opening in slide 22, thereby allowing the slide 22 to move linearly relative to housing portions 10 and 30, so as to selectively retract tips 25, 25'. As those of ordinary skill in the art will understand, such retraction of tips 25, 25', when properly juxtaposed with associated structures (such as locking bars) of a closable enclosure (or other similar arrangement), permit such closable enclosure to be selectively opened/unlocked (FIG. 4 configuration) and closed/locked (FIG. 3 configuration).

By the foregoing use of the present panel lock in conjunction with a locking bar system, the opening (and securing) of a cabinet door (such as that of an electrical distribution or control cabinet, or of a non-electrical environment, such as a postal box) may be selectively controlled. In operation, the present panel lock is designed to lift an associated bar when the panel lock is in a designated unlocked position, and is designed to prevent such lifting when it is in a designated locked position.

Through use of either a disc or pin tumbler plug assembly fitted into a housing and provided with a double-D protrusion on its back side (formed as part of the plug, or as affixed thereto), in conjunction with present housing and slide features, the slide 22 (when constrained by the housing) is allowed to move linearly (present FIG. 4) within the housing when the locking plug 26 is in its unlocked condition. As will be understood by those of ordinary skill in the art, lifting tips 25, 25' of the slide contact an associated locking bar or bars through an appropriate bracket so that when the slide is moved upward it causes the locking bar to move upward so as to unlatch an associated door. The double-D protrusions, in effect, ride in a grooved formed in slide 22 such that when the assembly is in its unlocked position, the slide 22 is allowed to move linearly. When the present subject matter is in its locked position (present FIG. 3), the slide is restricted from movement in any direction, which results in desired, selective securement of an associated door/enclosure. The overall assembly and present subject matter is such that when key 28 is removed, the locking plug 26 will not turn so that the slide 22 can not be released to move. Consequently, any associated door, enclosure, or the like, remains secured.

While the present subject matter has been described in detail with respect to specific embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A panel lock assembly for use with a locking bar of an associated selectively closable enclosure formed by sides and a front face opening for accessing such enclosure, said panel lock assembly comprising:

an elongated housing portion, configured to be received in an enclosure front face opening;

a slide element supported by said elongated housing portion, for user-actuated linear movement relative to said elongated housing portion, said slide element including at least one engagement tip for selectively engaging a locking bar of an associated enclosure, and said slide element defining an engageable key-hole shaped opening therethrough; and a rotatable plug assembly mounted in said elongated housing portion, said rotatable plug assembly including a key slot for receipt of a key to actuate rotation of said rotatable plug assembly, and including at least one protrusion extending therefrom and into said slide element engageable key-hole shaped opening, said at least one protrusion rotating in response to rotation of said rotatable plug assembly between a locking position and an unlocking position thereof;

wherein said at least one protrusion engages said slide element engageable key-hole shaped opening to prevent linear movement of said slide element whenever said rotatable plug assembly is in said locking position thereof, and to permit linear movement thereof whenever said rotatable plug assembly is in said unlocking position thereof, whereby a simplified panel lock assembly is provided to selectively actuate and secure a locking bar of an associated selectively closable enclosure;

said elongated housing portion is configured to include a pair of frictionally engaging retaining elements on opposite ends thereof, a window opening through said elongated housing portion for user-actuation of said slide element, and a surrounding lip portion arranged with the remainder of said elongated housing portion so as to facilitate "snap-in" mounting of said panel lock assembly into the front face opening of an associated enclosure;

said slide element includes a recessed portion thereof which may be accessed via said window opening of said elongated housing portion to effect linear movement of said slide element;

said panel lock assembly further includes a bottom housing portion beneath said elongated housing portion and cooperating therewith for retaining said slide element in linear movement relationship relative to said elongated housing portion;

said slide element further includes a pair of safety side wing elements for shielding access into the interior of an associated enclosure; and said at least one protrusion of said rotatable plug assembly includes a pair of D-shaped protrusions, engageable in one orientation with said slide element engageable key-hole shaped opening so as to prevent linear movement of said slide element which consequently prevents engagement of said slide element at least one engagement tip engaging a locking bar of an associated enclosure, and engageable in another orientation with said slide element engageable key-hole shaped opening so as to permit linear movement of said slide element which consequently permits engagement of said slide element at least one engagement tip engaging a locking bar of an associated enclosure.

2. A panel lock assembly as in claim 1, wherein:

said elongated housing portion and said slide element are comprised of non-conductive materials.

3. A panel lock assembly for use with a locking bar of an associated selectively closable enclosure formed by sides and a front face opening for accessing such enclosure, said panel lock assembly comprising:

an elongated housing portion, configured to be received in an enclosure front face opening;

a slide element supported by said elongated housing portion, for user-actuated linear movement relative to said elongated housing portion, said slide element including at least one engagement tip for selectively engaging a locking bar of an associated enclosure, and said slide element defining an engageable key-hole shaped opening therethrough; and a rotatable plug assembly mounted in said elongated housing portion, said rotatable plug assembly including a key slot for receipt of a key to actuate rotation of said rotatable plug assembly, and including at least one protrusion extending therefrom and into said slide element engageable key-hole shaped opening, said at least one protrusion rotating in response to rotation of said rotatable plug assembly between a locking position and an unlocking position thereof;

wherein said at least one protrusion engages said slide element engageable key-hole shaped opening to prevent linear movement of said slide element whenever said rotatable plug assembly is in said locking position thereof, and to permit linear movement thereof whenever said rotatable plug assembly is in said unlocking position thereof, whereby a simplified panel lock assembly is provided to selectively actuate and secure a locking bar of an associated selectively closable enclosure; and wherein said elongated housing portion is configured to include a pair of frictionally engaging retaining elements on opposite ends thereof, a window opening through said elongated housing portion for user-actuation of said slide element, and a surrounding lip portion arranged with the remainder of said elongated housing portion so as to facilitate "snap-in" mounting of said panel lock assembly into the front face opening of an associated enclosure.

4. A panel lock assembly as in claim 3, wherein said elongated housing portion and said slide element are comprised of non-conductive materials.

5. A panel lock assembly as in claim 3, wherein said slide element includes a recessed portion thereof which may be accessed via said window opening of said elongated housing portion to effect linear movement of said slide element.

6. A panel lock assembly as in claim 5, further including;

a bottom housing portion beneath said elongated housing portion and cooperating therewith for retaining said slide element in linear movement relationship relative to said elongated housing portion; and wherein said slide element further includes a pair of safety side wing elements for shielding access into the interior of an associated enclosure.

7. A panel lock assembly as in claim 3, wherein:

said at least one protrusion of said rotatable plug assembly includes a pair of D-shaped protrusions, engageable in one orientation with said slide element engageable key-hole shaped opening so as to prevent linear movement of said slide element which consequently prevents engagement of said slide element at least one engagement tip engaging a locking bar of an associated enclosure, and engageable in another orientation with said slide element engageable key-hole shaped opening so as to permit linear movement of said slide element which consequently permits engagement of said slide element at least one engagement tip engaging a locking bar of an associated enclosure.

8. A snap-in panel lock assembly for receipt into a front face opening of an associated selectively closable enclosure, said panel lock assembly comprising:

an elongated housing portion, defining a snap-in upper lip portion configured for receipt of said elongated housing portion in an enclosure front face opening, and defining a window opening therethrough;

a rotatable plug assembly mounted in said elongated housing portion, said rotatable plug assembly including a key slot for receipt of a key to actuate rotation of said rotatable plug assembly;

a slide element supported by said elongated housing portion, for linear movement thereof relative to said elongated housing portion per user actuation of said slide element through said window opening, said slide element defining at least one engagement protection extending therefrom, and defining an engageable opening therethrough, said engageable opening being asymmetrical along an axis perpendicular to the linear movement direction of said slide element;

a bottom housing portion beneath said elongated housing portion and cooperating therewith for retaining said slide element in linear movement relationship relative to said elongated housing portion; and at least one asymmetrically shaped protrusion extending beneath said rotatable plug assembly for rotation therewith, and extending into said slide element engageable opening, said at least one protrusion rotating in response to rotation of said rotatable plug assembly between a locking position and an unlocking position thereof;

wherein said at least one protrusion engages said slide element engageable opening to prevent linear movement of said slide element whenever said rotatable plug assembly is in said locking position thereof, and to permit linear movement thereof whenever said rotatable plug assembly is in said unlocking position thereof;

said slide element engageable opening is generally keyhole-shaped; and said at least one protrusion of said rotatable plug assembly includes a pair of D-shaped protrusions, engageable in one orientation with said slide element engageable opening so as to prevent linear movement of said slide element which consequently prevents engagement of said slide element at least one engagement tip engaging a locking bar of an associated enclosure, and engageable in another orientation with said slide element engageable opening so as to permit linear movement of said slide element.

9. A panel lock assembly as in claim 8, wherein said elongated housing portion, said bottom housing portion, and said slide element are comprised of non-conductive materials.

10. A panel lock assembly as in claim 8, wherein:

said elongated housing portion is configured to include a pair of frictionally engaging retaining elements on opposite ends thereof;

said slide element includes a recessed portion thereof which may be accessed via said window opening of said elongated housing portion to effect linear movement of said slide element; and said slide element further includes a pair of safety side wing elements for shielding access into the interior of an associated enclosure.

11. A snap-in panel lock assembly for receipt into a front face opening of an associated selectively closable enclosure, said panel lock assembly comprising:

an elongated housing portion, defining a snap-in upper lip portion configured for receipt of said elongated housing portion in an enclosure front face opening, and defining a window opening therethrough;

a rotatable plug assembly mounted in said elongated housing portion, said rotatable plug assembly including a key slot for receipt of a key to actuate rotation of said rotatable plug assembly;

a slide element supported by said elongated housing portion, for linear movement thereof relative to said elongated housing portion per user actuation of said slide element through said window opening, said slide element defining at least one engagement protection extending therefrom, and defining an engageable opening therethrough, said engageable opening being asymmetrical along an axis perpendicular to the linear movement direction of said slide element;

a bottom housing portion beneath said elongated housing portion and cooperating therewith for retaining said slide element in linear movement relationship relative to said elongated housing portion; and at least one asymmetrically shaped protrusion extending beneath said rotatable plug assembly for rotation therewith, and extending into said slide element engageable opening, said at least one protrusion rotating in response to rotation of said rotatable plug assembly between a locking position and an unlocking position thereof;

wherein said at least one protrusion engages said slide element engageable opening to prevent linear movement of said slide element whenever said rotatable plug assembly is in said locking position thereof, and to permit linear movement thereof whenever said rotatable plug assembly is in said unlocking position thereof;

said elongated housing portion is configured to include a pair of frictionally engaging retaining elements on opposite ends thereof;

said slide element includes a recessed portion thereof which may be accessed via said window opening of said elongated housing portion to effect linear movement of said slide element;

said slide element further includes a pair of safety side wing elements for shielding access into the interior of an associated enclosure;

said slide element engageable opening is generally keyhole-shaped; and said at least one protrusion of said rotatable plug assembly includes a pair of D-shaped protrusions, engageable in one orientation with said slide element engageable opening so as to prevent linear movement of said slide element, and engageable in another orientation with said slide element engageable opening so as to permit linear movement of said slide element.

12. A snap-in panel lock assembly as in claim 11, wherein said elongated housing portion, said bottom housing portion, and said slide element are comprised of non-conductive materials.

* * * * *